US010714039B2

(12) United States Patent
Sasaki

(10) Patent No.: US 10,714,039 B2
(45) Date of Patent: Jul. 14, 2020

(54) DISPLAY DEVICE AND DATA TRANSMISSION METHOD IN DISPLAY DEVICE

(71) Applicant: SAKAI DISPLAY PRODUCTS CORPORATION, Sakai-shi, Osaka (JP)

(72) Inventor: Takashi Sasaki, Sakai (JP)

(73) Assignee: SAKAI DISPLAY PRODUCTS CORPORATION, Sakai-shi, Osaka (JP)

( * ) Notice: Subject to any disclaimer, the term of this patent is extended or adjusted under 35 U.S.C. 154(b) by 0 days.

(21) Appl. No.: 16/548,073

(22) Filed: Aug. 22, 2019

(65) Prior Publication Data

US 2020/0066222 A1 Feb. 27, 2020

(30) Foreign Application Priority Data

Aug. 23, 2018 (JP) ..... 2018-156305

(51) Int. Cl.
*G09G 3/36* (2006.01)

(52) U.S. Cl.
CPC ..... *G09G 3/3648* (2013.01); *G09G 3/3611* (2013.01); *G09G 2300/06* (2013.01); *G09G 2300/0876* (2013.01); *G09G 2310/08* (2013.01); *G09G 2370/08* (2013.01)

(58) Field of Classification Search
CPC combination set(s) only.
See application file for complete search history.

(56) References Cited

U.S. PATENT DOCUMENTS 9,240,231 B2 1/2016 Ishikuri
2010/0253672 A1* 10/2010 Ota ..... G09G 3/3648 345/213
2015/0213874 A1 7/2015 Ishikuri

FOREIGN PATENT DOCUMENTS

JP 2015-142178 A 8/2015

* cited by examiner

*Primary Examiner* — Deeprose Subedi
(74) *Attorney, Agent, or Firm* — ScienBiziP, P.C.

(57) ABSTRACT

At a previous stage prior to displaying an input image in a display region, a display device outputs, to a transmitting section, a first instruction to transmit a first data signal having a specific pattern with a phase difference from a clock signal set to a first phase difference; reads, from a receiving section, a first received data signal corresponding to a data signal received by the receiving section from the transmitting section having received the first instruction; performs, as receipt result determination, first determination based on the first data signal and the first received data signal as receipt result determination; and determines, based on a result of the first determination, a set phase difference corresponding to the phase difference from the clock signal employed in transmitting the data signal based on the input data.

14 Claims, 13 Drawing Sheets

DISPLAY DEVICE AND DATA TRANSMISSION METHOD IN DISPLAY DEVICE

INCORPORATION BY REFERENCE

The present application claims priority under 35 U.S.C. § 119 to Japanese Patent Application No. 2018-156305, filed on Aug. 23, 2018. The contents of this application are incorporated herein by reference in their entirety.

BACKGROUND

The present disclosure relates to a display device and a data transmission method performed in the display device.

Display devices have been further developed to have a higher resolution. For example, a display device applicable to 8K resolution displays images with a resolution of 7680×4320 pixels at a rate of 120 frames/sec. In a display device having a high resolution, it is necessary to perform high-speed transmission of signals of a huge amount of data (such as control data for displaying images based on image data) within the device. When data signals cannot be rapidly transmitted certainly, noise occurs in a displayed image.

As a method for improving the certainty of data receipt on a receiving side, a method in which latch timing is adjusted (tuned) by a reader (host device) reading data from a recording medium has been proposed. This reader transmits, together with a clock signal, a data transmission request signal to the recording medium, and receives data from the recording medium with latching data signal transmitted as a response to the transmission request. Although a data signal from a recording medium is delayed by a standardized fixed value in general in consideration that the data signal is delayed from transmission timing of the transmission request signal, the proposed reader performs processing for selecting appropriate latch timing in accordance with a temperature change, an individual difference of the recording medium and the like.

SUMMARY

A display device according to one embodiment of the present disclosure includes: a display panel having a display region constituted by a plurality of pixels; and a signal processing section configured to perform prescribed signal processing on input data including pixel values of the respective plurality of pixels for generating first output data for displaying an input image based on the input data in the display region, and the signal processing section includes: a receiving section; a transmitting section configured to transmit, to the receiving section, a data signal based on the input data or a specified data signal in synchronization with a clock signal; and a controller connected to the receiving section and the transmitting section, at a previous stage prior to displaying the input image in the display region, the controller issues, to the transmitting section, a first instruction to transmit a first data signal having a specific pattern with a phase difference from the clock signal set to a first phase difference; reads, from the receiving section, a first received data signal corresponding to a data signal received by the receiving section from the transmitting section having received the first instruction; performs first determination based on the first data signal and the first received data signal as receipt result determination whether or not the data signal transmitted by the transmitting section has been able to be correctly received by the receiving section; and determines, based on a result of the first determination, a set phase difference corresponding to a phase difference from the clock signal employed in transmitting the data signal based on the input data.

A data transmission method performed in a display device according to one embodiment of the present invention is a data transmission method performed in a display device including: a display panel having a display region constituted by a plurality of pixels; and a signal processing section including a receiving section and a transmitting section, and configured to perform prescribed signal processing on input data including pixel values of the respective plurality of pixels for generating output data for displaying an input image based on the input data in the display region. In the data transmission method, at a previous stage prior to displaying the input image in the display region, the display device: issues, to the transmitting section, a first instruction to transmit a first data signal having a specific pattern with a phase difference from a clock signal set to a first phase difference; reads, from the receiving section, a first received data signal corresponding to a data signal received by the receiving section from the transmitting section having received the first instruction; performs determination based on the first data signal and the first received data signal as receipt result determination whether or not the data signal transmitted by the transmitting section has been able to be correctly received by the receiving section; and determines, based on a result of the determination, a set phase difference corresponding to a phase difference from the clock signal employed in transmitting the data signal based on the input data, and at a display stage for displaying the input image in the display region, the transmitting section transmits the data signal based on the input data with the set phase difference.

DETAILED DESCRIPTION

Now, embodiments of the present disclosure will be specifically described with reference to the accompanying drawings. The following embodiments are merely illustrative and it goes without saying that the present disclosure is not limited to the following structure.

First Embodiment

Figure 1:
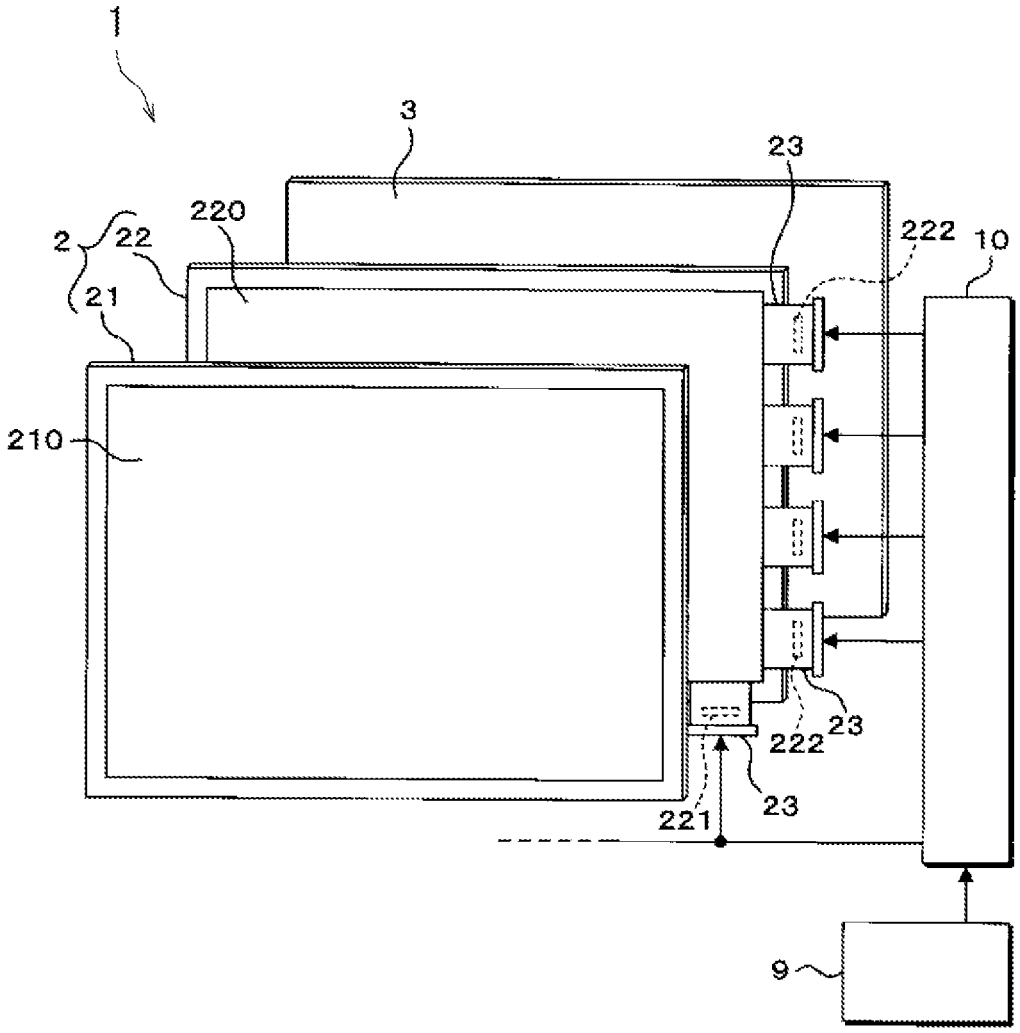
FIG. 1 is a diagram illustrating a structure of a display device according to a first embodiment.

FIG. 1 is a diagram illustrating a structure of a display device 1 according to a first embodiment. The display device 1 is, for example, a liquid crystal display device, and includes a liquid crystal panel 2, a light source device 3, an input circuit 9, and a signal processing circuit 10. The liquid crystal panel 2 is connected to the signal processing circuit 10.

The liquid crystal panel 2 includes a display region 210 (220) constituted by a plurality of pixels disposed in a matrix, and employs an active matrix method in which the brightness of each pixel in the display region 210 is controlled by a thin film transistor (TFT). The liquid crystal panel 2 includes a pair of glass substrates, and a liquid crystal material sealed between the pair of glass substrates. One of the glass substrates is a TFT substrate 22 in which pixel electrodes, TFTs, bus lines, and the like are formed. The other of the glass substrates is a CF substrate 21 in which elements of a color filter (CF), counter electrodes respectively opposing the pixel electrodes, and the like are formed.

In the CF substrate 21, a black matrix, the color filter, an insulating film, the counter electrodes, and an alignment film are successively formed. In the TFT substrate 22, a pixel electrode, a TFT and an auxiliary capacitance constituting each pixel, and a bus line connected to each pixel are formed. To the TFT substrate 22, a flexible substrate 23 on which a source driver 221 and a gate driver 222 outputting a signal for control are mounted is connected.

The light source device 3 is an edge-light type or direct type light source device, and includes a light source using a light emitting diode (LED), laser, or the like, a light guide plate or diffusion plate, and an optical sheet.

The input circuit 9 inputs externally received image data to the signal processing circuit 10. The image data includes pixel values of the respective plural pixels disposed in the display region 210.

The signal processing circuit 10 performs prescribed signal processing on image data (input data) input from the input circuit 9 to generate control data for displaying an image (input image) based on the image data in the display region 210. The signal processing circuit 10 outputs a part of the generated control data (first output data) to the source driver 221, and outputs another part of the generated control data to the gate driver 222. Besides, the signal processing circuit 10 outputs, at a previous stage prior to displaying the input image in the display region 210, control data for displaying the plural pixels disposed in the display region 210 in black (second output data) to the source driver 221.

The display device 1 is configured by providing the light source device 3 on the side of the TFT substrate 22 of the liquid crystal panel 2. In the display device 1, a voltage is applied to the pixel electrode of each pixel by the source driver 221 and the gate driver 222 based on the control data output from the signal processing circuit 10. Since a voltage is thus applied to the pixel electrode, the alignment direction of liquid crystal molecules of each pixel is controlled between the pixel electrode of the TFT substrate 22 and the counter electrode of the CF substrate 21, and thus, a light transmission amount of each pixel is adjusted to display an image in the display region 210.

Figure 2:
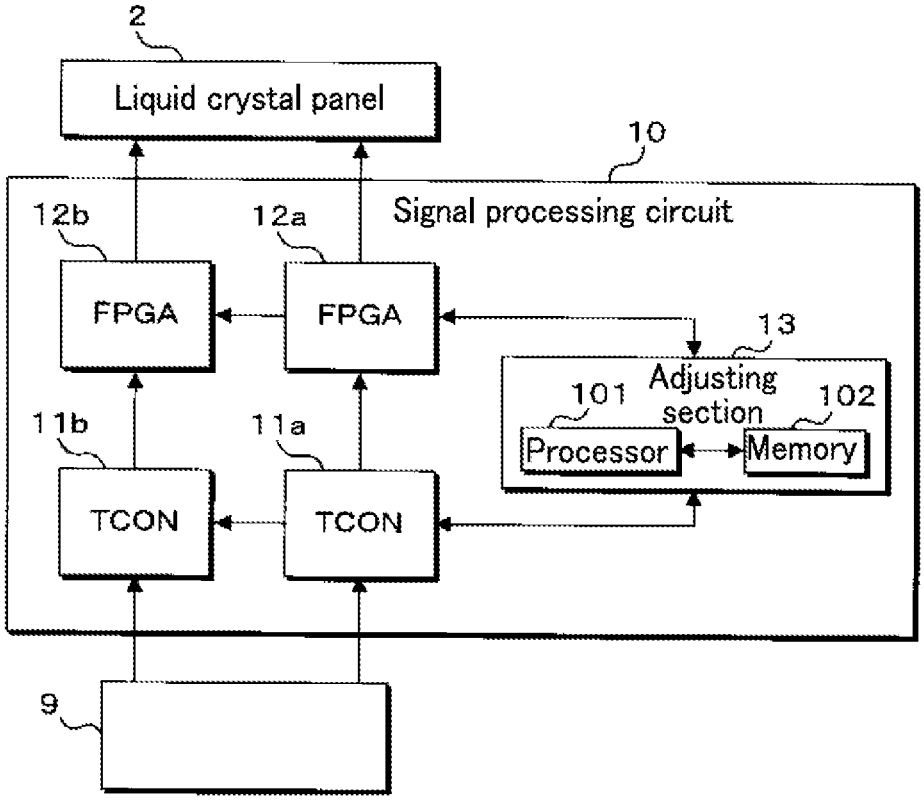
FIG. 2 is a diagram illustrating a configuration of a signal processing circuit of the first embodiment.

FIG. 2 is a diagram illustrating a configuration of the signal processing circuit 10 of the first embodiment. The signal processing circuit 10 includes TCONs 11*a* and 11*b* (transmitting sections) in number according to a division number of the display region 210 (which is two in the present embodiment), field-programmable gate arrays (FPGAs) 12*a* and 12*b* (receiving sections) in number according to the division number of the display region 210 (which is two in the present embodiment), and an adjusting section 13 (controller).

The TCONs 11*a* and 1 *b* transmit, respectively to the FPGAs 12*a* and 12*b*, a data signal (including for example a source signal and a gate signal) based on the image data input from the input circuit 9 in synchronization with a clock signal. The TCON 11*a* is connected to the adjusting section 13, and when an instruction is received from the adjusting section 13, the TCON 11*a* operates based on the instruction. The TCON 11*a* and the TCON 11*b* are connected to each other, and when the instruction is received from the adjusting section 13 via the TCON 11*a*, the TCON 11*b* operates based on the instruction.

The FPGAs 12*a* and 12*b* are configured to perform prescribed processing on the received data signal. For example, the FPGAs 12*a* and 12*b* perform signal processing such as gamma conversion processing, overdrive processing, and dither processing through combination with the TCONs 11*a* and 11*b*. The FPGA 12*a* is connected to the adjusting section 13, and the adjusting section 13 can read out a data signal received by the FPGA 12*a*. The FPGA 12*b* is connected to the FPGA 12*a*, and the adjusting section 13 can read out, via the FPGA 12*a*, a data signal received by the FPGA 12*b*.

The adjusting section 13 includes a processor 101 and memory 102. The processor 101 executes various programs stored in the memory 102 with reference to various data stored in the memory 102, and thus, functions of the adjusting section 13 are realized. The adjusting section 13 adjusts a phase difference (set phase difference) from a clock signal in transmitting a data signal by the TCONs 11*a* and 1*b*. The adjusting section 13 issues, to the TCONs 11*a* and 11*b*, an instruction to transmit a specified signal with a phase difference between a clock signal and a data signal (phase difference from the clock signal in transmitting the data signal) set to a specified value. Besides, the adjusting section 13 reads the data signal received by the FPGAs 12*a* and 12*b* and holds the read data signal.

Figure 3:
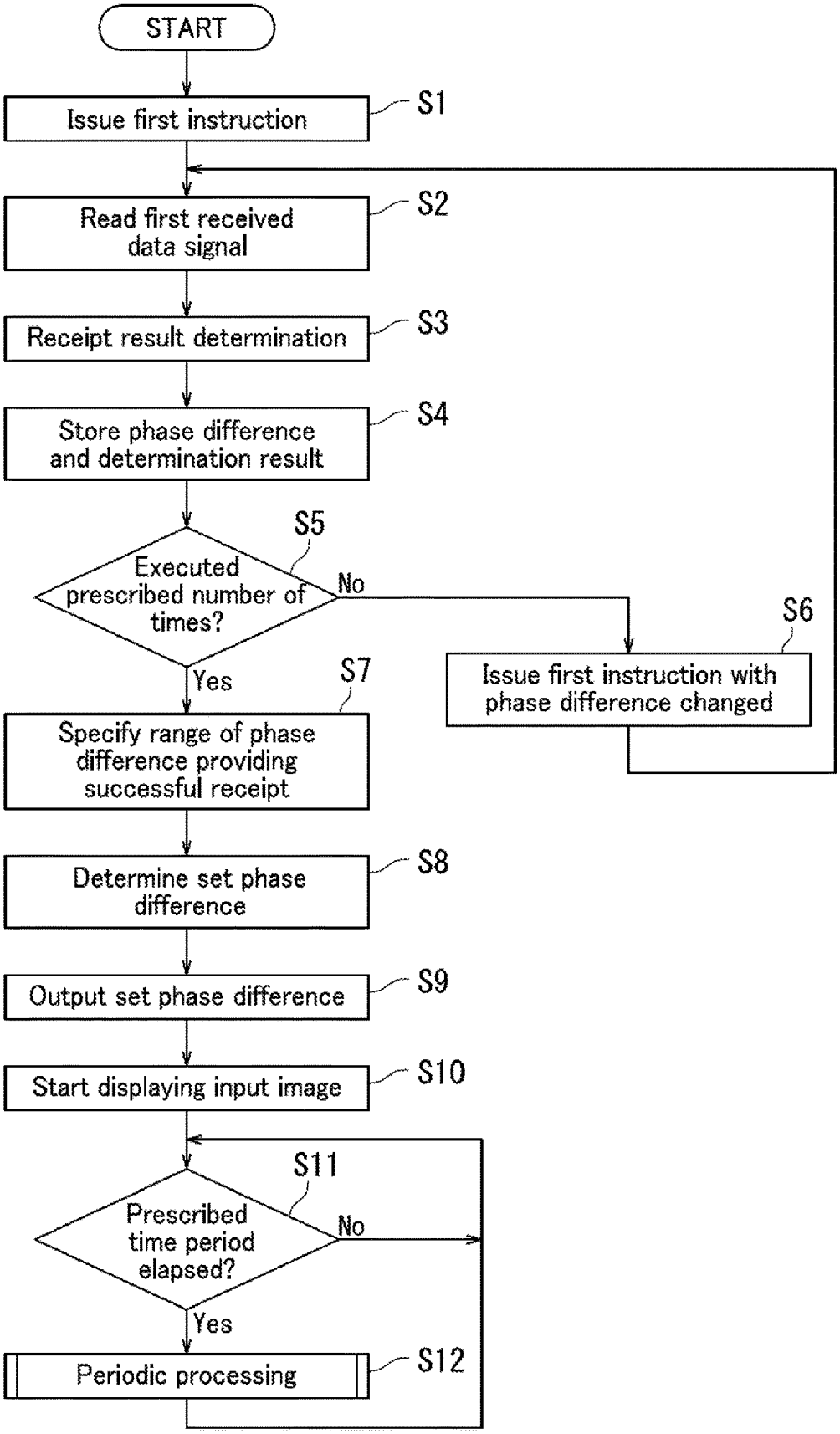
FIG. 3 is a flowchart illustrating adjusting procedures executed by the signal processing circuit.

In the signal processing circuit 10 of the display device 1 according to the present disclosure, the adjusting section 13 optimizes a phase (timing) between the data signal and the clock signal in transmitting the data signal from the TCONs 11*a* and 11*b* to the FPGAs 12*a* and 12*b*. FIG. 3 is a flowchart of adjusting procedures executed by the signal processing circuit 10.

First, at a previous stage prior to displaying an input image in the display region 210, the adjusting section 13 issues, to the TCONs 11*a* and 11*b*, a first instruction to transmit a first data signal having a specific pattern with the phase difference from the clock signal set to a first phase difference (Step S1). The first data signal is a data signal having a pattern for causing the signal level to continuously rise and fall a plurality of times in the same cycle as the clock signal. Incidentally, at the previous stage, the FPGAs 12*a* and 12*b* keep on transmitting, to the liquid crystal panel 2, control data (second output data) for displaying the whole display region 210 in black.

Next, the adjusting section 13 reads, from the FPGAs 12*a* and 12*b*, a first received data signal corresponding to a data signal received by the FPGA 12*a* and 12*b* from the TCONs 11*a* and 11*b* having received the first instruction (Step S2).

Next, the adjusting section 13 performs, as receipt result determination whether or not the data signal transmitted by the TCONs 11*a* and 11*b* could be correctly received by the FPGAs 12*a* and 12*b*, first determination based on the first data signal and the first received data signal (Step S3). Specifically, when the first received data signal read from the FPGAs 12*a* and 12*b* accords with the first data signal, the adjusting section 13 determines the result of the first determination as positive, namely, determines that the first data signal transmitted by the TCONs 11*a* and 11*b* could be correctly received by the FPGAs 12*a* and 12*b*. On the other hand, when the first received data signal read from the FPGAs 12*a* and 12*b* does not accord with the first data signal, the adjusting section 13 determines the result of the first determination as negative, namely, determines that the first data signal transmitted by the TCONs 11*a* and 11*b* could not be correctly received by the FPGAs 12*a* and 12*b*. The adjusting section 13 stores, in the memory 102, the first phase difference specified by the first instruction and the result of the first determination in association (Step S4).

Thereafter, the adjusting section 13 determines whether or not the procedures of Steps S1 to S4 have been executed a prescribed number of times (Step S5). When it is determined that the procedures have not been executed the prescribed number of times (Step S5: NO), the adjusting section 13 issues the first instruction again to the TCONs 11*a* and 11*b* with the first phase difference changed to a value increased by a prescribed increment from the previously specified value (Step S6), and returns the processing to Step S1.

On the other hand, when it is determined in Step S5 that the procedures have been executed the prescribed number of times (Step S5: YES), the adjusting section 13 specifies, based on association relationship between the first phase difference and the result of the first determination stored in the memory 102, a range of at least one first phase difference with which the FPGAs 12*a* and 12*b* could correctly receive the first data signal (Step S7). Then, the adjusting section 13 determines, as the set phase difference (optimum value of the phase difference), a median of the range of the at least one first phase difference specified in Step S7 (Step S8).

Thereafter, the adjusting section 13 outputs, to the TCONs 11*a* and 11*b*, an instruction signal for instructing to output the data signal based on the image data with the thus determined set phase difference (Step S9), and informs the FPGAs 12*a* and 12*b* of the instruction. The TCONs 11*a* and 11*b* having received the instruction signal set the phase difference between the clock signal and the data signal to the determined set phase difference.

Thereafter, the input image is started to be displayed in the display region 210 (Step S10). At a display stage for displaying the input image in the display region 210, the TCONs 11*a* and 11*b* transmit the data signal based on the image data with the set phase difference. After being informed, the FPGAs 12*a* and 12*b* generate control data through prescribed processing based on the data signal received from the TCONs 11*a* and 11*b*, and output the generated control data to the liquid crystal panel 2.

Thereafter, at the display stage, the adjusting section 13 performs the receipt result determination periodically or irregularly, and performs phase difference update processing for changing the set phase difference when the result of the receipt result determination is negative (Steps S11 and S12). In the present embodiment, the adjusting section 13 executes the periodic processing (Step S12) after every elapse of a prescribed period (of, for example, 30 minutes) (Step S11: YES). Thereafter, the adjusting section 13 continuously performs the procedures of Steps S11 and S12 until the power is turned off.

Figure 4:
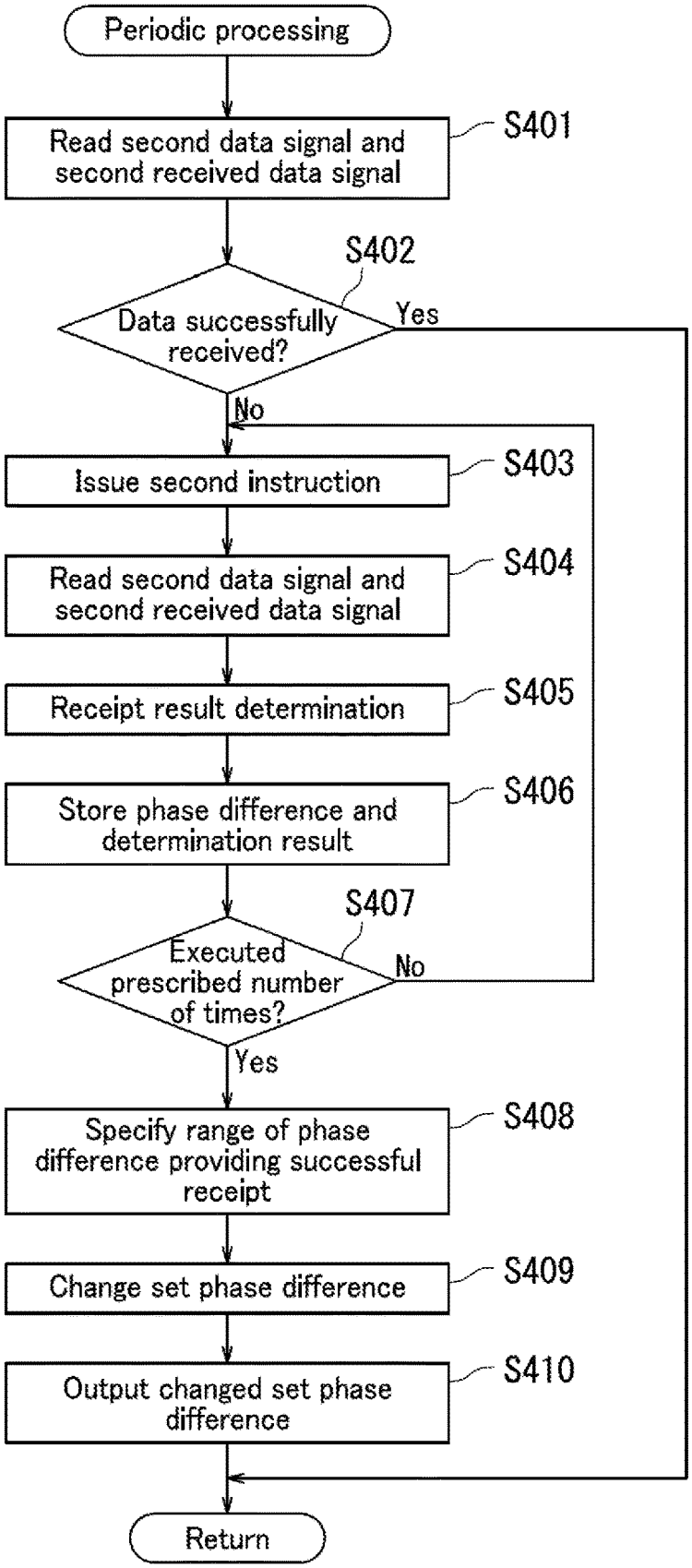
FIG. 4 is a flowchart of periodic processing performed in the first embodiment.

FIG. 4 is a flowchart of the periodic processing performed in the first embodiment.

In the periodic processing of the first embodiment, the adjusting section 13 first reads a second data signal from the TCONs 11*a* and 11*b* having transmitted the second data signal indicating a pixel value of a specific pixel included in the data signals based on the image data, and reads a second received data signal corresponding to a data signal received by the FPGAs 12*a* and 12*b* from the TCONs 11*a* and 11*b* having transmitted the second data signal (Step S401).

Next, the adjusting section 13 performs, as the receipt result determination, second determination based on the second data signal and the second received data signal (Step S402). Specifically, when the second received data signal read from the FPGAs 12*a* and 12*b* accords with the second data signal read from the TCONs 11*a* and 11*b*, the adjusting section 13 determines the result of the second determination as positive, namely, determines that the second data signal transmitted by the TCONs 11*a* and 11*b* could be correctly received by the FPGAs 12*a* and 12*b*. On the other hand, when the second received data signal read from the FPGAs 12*a* and 12*b* does not accord with the second data signal read from the TCONs 11*a* and 11*b*, the adjusting section 13 determines the result of the second determination as negative, namely, determines that the second data signal transmitted by the TCONs 11*a* and 11*b* could not be correctly received by the FPGAs 12*a* and 12*b*.

When the result of the second determination is positive (Step S402: YES), the adjusting section 13 completes one periodic processing, and returns the processing to Step S11 of the flowchart of FIG. 3.

On the other hand, when the result of the second determination is negative (Step S402: NO), the adjusting section 13 issues, to the TCONs 11*a* and 11*b*, a second instruction, regarding transmission of the second data signal with the phase difference from the clock signal set to a second phase difference, to increase the second phase difference by a prescribed increment every time the second data signal is transmitted (Step S403). Then, the adjusting section 13 repeatedly performs the second determination regarding the second instruction a plurality of times.

Specifically, every time the TCONs 11*a* and 11*b* transmit the second data signal after the issue of the second instruction, the adjusting section 13 reads the second data signal from the TCONs 11*a* and 11*b* and reads the second received data signal from the FPGAs 12*a* and 12*b* (Step S404). Then, the adjusting section 13 performs the second determination based on the second data signal and the second received data signal read in Step S404 (Step S405). The adjusting section 13 stores, in the memory 102, the second phase difference specified by the second instruction and the result of the second determination in association (Step S406).

The adjusting section 13 determines whether or not the procedures of Steps S403 to S406 have been executed a prescribed number of times (Step S407). When it is determined that the procedures have not been executed the prescribed number of times (Step S407: NO), the adjusting section 13 returns the processing to Step S403.

On the other hand, when it is determined in Step S407 that the procedures have been executed the prescribed number of times (Step S407: YES), the adjusting section 13 specifies, based on association relationship between the second phase difference and the result of the second determination stored in the memory 102, a range of at least one second phase difference with which the FPGAs 12*a* and 12*b* could correctly receive the second data signal (Step S408). Then, the adjusting section 13 changes the set phase difference to a medium of the range of the at least one second phase difference specified in Step S408 (Step S409).

Thereafter, the adjusting section 13 outputs, to the TCONs 11*a* and 11*b*, an instruction signal for instructing to output the data signal based on the image data with the changed set phase difference (Step S410). The TCONs 11*a* and 11*b* having received the instruction signal set the phase difference between the clock signal and the data signal to the changed set phase difference. Thereafter, the TCONs 11*a* and 11*b* transmit the data signal based on the image data with the changed set phase difference.

The adjusting section 13 completes one periodic processing after Step S410, and returns the processing to Step S11 of the flowchart of FIG. 3.

Figure 5:
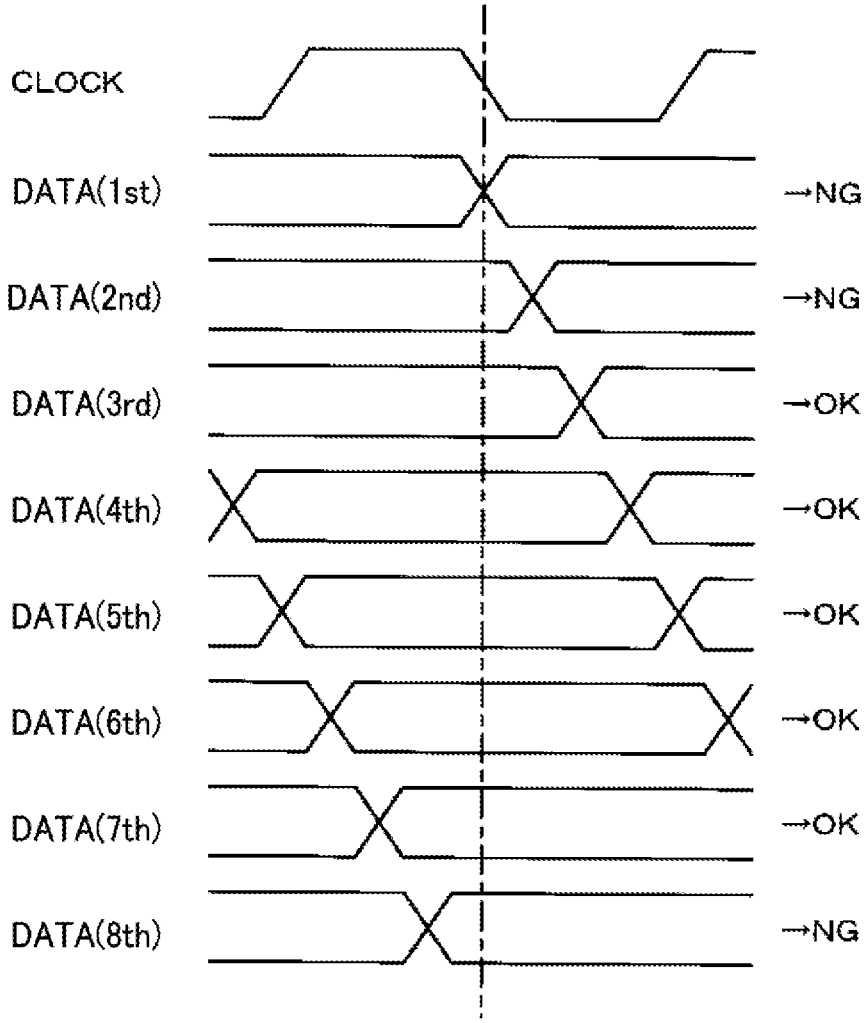
FIG. 5 is an explanatory diagram of an operation of an adjusting section.

FIG. 5 is an explanatory diagram of an operation of the adjusting section 13. FIG. 5 is a time chart illustrating the phase difference between the clock signal and the data signal. The abscissa indicates time, and the ordinate indicates the signal level.

In the time chart of FIG. 5, the adjusting section 13 causes the TCONs 11*a* and 11*b* to transmit the first data signal eight times with the first phase difference changed. In other words, FIG. 5 illustrates an exemplified case where the prescribed number of times employed in Step S5 is eight. It is noted that the prescribed number of times employed in Step S5 is not limited to eight.

"DATA (1st)" in this drawing indicates a time chart employed in the first transmission, and indicates a time chart employed when the TCONs 11*a* and 11*b* transmit the first data signal with the prescribed first phase difference. "DATA (2nd)" in this drawing indicates a time chart employed in the second transmission, and indicates a time chart employed when the TCONs 11*a* and 11*b* transmit the first data signal with the first phase difference larger by the prescribed increment than the first phase difference employed in the previous (first) transmission. "DATA (3rd)" in this drawing indicates a time chart employed in the third transmission, and indicates a time chart employed when the TCONs 11*a* and 11*b* transmit the first data signal with the first phase difference larger by the prescribed increment than the first phase difference employed in the previous (second) transmission. Each of "DATA (4th)" to "DATA (8th)" in this drawing similarly indicates a time chart employed in the fourth to eighth transmission, and indicates a time chart employed when the TCONs 11*a* and 11*b* transmit the first data signal with the first phase difference larger by the prescribed increment than the first phase difference employed in the previous (third to seventh) transmission.

In the exemplified case of FIG. 5, the adjusting section 13 specifies the range of the first phase difference employed in each of the third to seventh transmissions as the range of the first phase difference employed when the FPGAs 12*a* and 12*b* could correctly receive the first data signal. In this case, the adjusting section 13 determines, as the set phase difference, a median of the specified range of the first phase difference, namely, the first phase difference employed in the fifth transmission.

Figure 6:
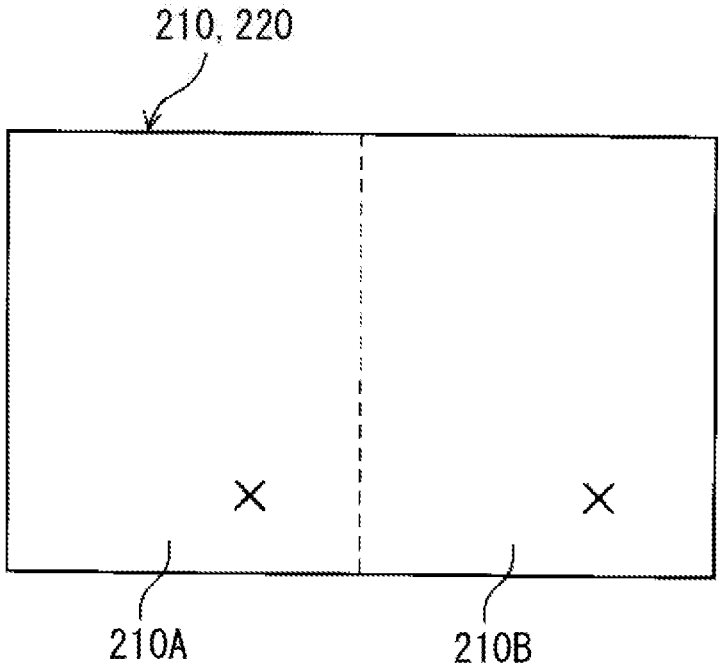
FIG. 6 is a schematic diagram illustrating a position of a specific pixel.

FIG. 6 is a schematic diagram illustrating the position of a specific pixel. FIG. 6 illustrates a case where the display region 210 is divided into two regions. In one region 210A obtained by dividing the display region 210 into two regions, an input image is displayed in accordance with control data based on the data signal transmitted from the TCON 11*a* to the FPGA 12*a*, and in the other region 210B, an input image is displayed in accordance with control data based on the data signal transmitted from the TCON 11*b* to the FPGA 12*b*. "X" in the drawing indicates a specific pixel in each of the regions 210A and 210B. After the TCONs 11*a* and 11*b* start to output the data signal based on the image data, the adjusting section 13 periodically or irregularly performs the receipt result determination on the second data signal indicating a pixel value of the specific pixel indicated by "X" in the drawing, and when the result of the determination is negative, the adjusting section 13 performs the phase difference update processing for changing the set phase difference. Incidentally, this processing is performed merely once in a prescribed period (of, for example, 30 minutes) on a specific one pixel included in one frame out of 120 frames or 60 frames per second, and hence does not affect display quality.

In this manner, at the time of activation, the display device 1 can first optimize the phase difference (set phase difference) from the clock signal in transmitting the data signal in accordance with the ambient environment including an environmental temperature. Furthermore, the set phase difference can be optimized in accordance with change of the temperature or the like occurring during the operation. As a result, noise generation can be inhibited not only at the time of activation but also during the operation so as to retain the display quality.

Incidentally, although the adjusting section 13 issues the first instruction again in Step S6 with the first phase difference changed to a value obtained by increasing the previously specified value by the prescribed increment, the first instruction can be issued again with the first phase difference changed to a value obtained by decreasing the previously specified value by a prescribed decrement. Similarly, although the adjusting section 13 issues, in Step S403, the second instruction to increase the second phase difference by the prescribed increment successively every time the second data signal is transmitted, the second instruction may be an instruction to decrease the second phase difference by a prescribed decrement successively every time the second data signal is transmitted.

Second Embodiment

Figure 7:
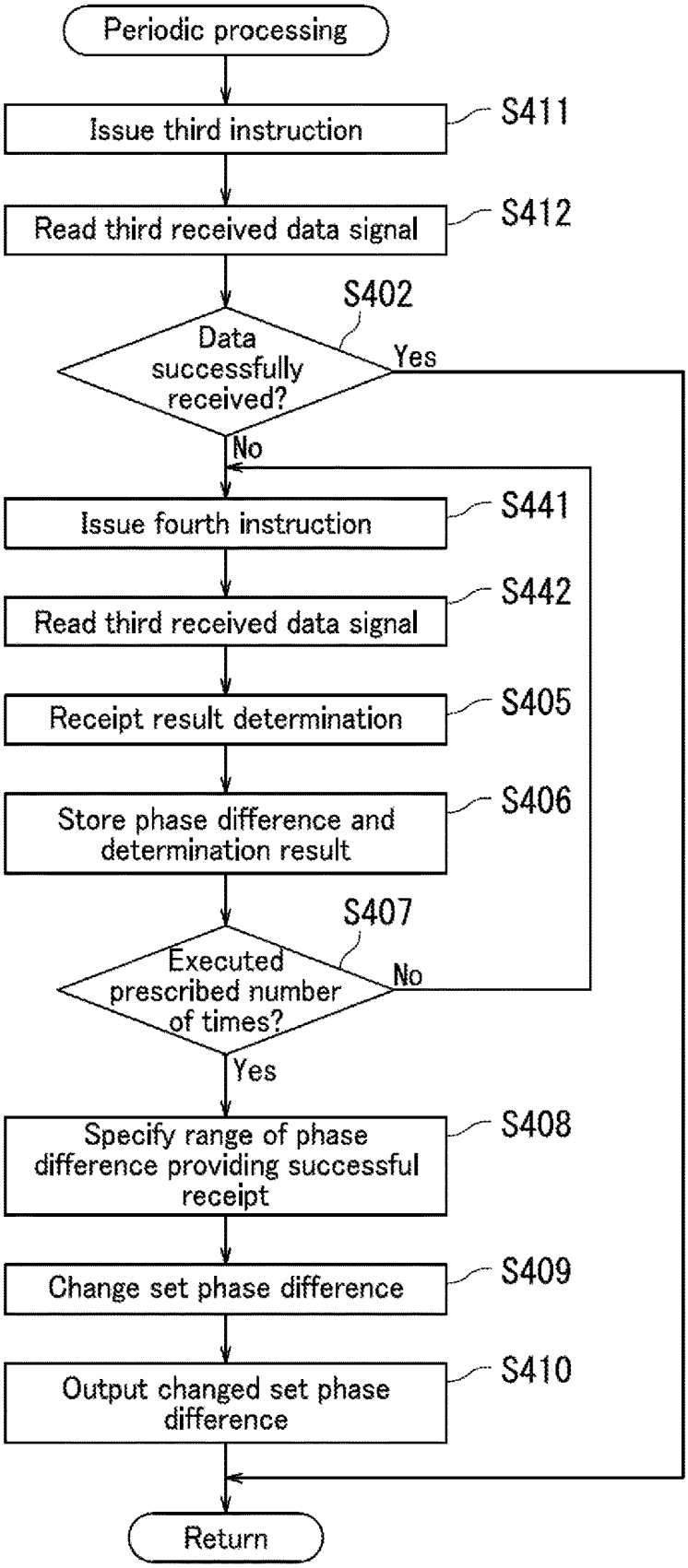
FIG. 7 is a flowchart of periodic processing performed in a second embodiment.

The structure of a display device 1 according to a second embodiment is the same as that of the first embodiment except for details of the processing performed by the signal processing circuit 10, and hence like reference signs are used to refer to like elements to avoid redundant detailed description. FIG. 7 is a flowchart of periodic processing of the second embodiment. Among procedures illustrated in the flowchart of FIG. 7, procedures common to those illustrated in the flowchart of FIG. 4 of the first embodiment are referred to with the same step numbers.

In the periodic processing of the second embodiment, the adjusting section 13 first issues, to the TCONs 11*a* and 11*b*, a third instruction to transmit a third data signal having a specific pattern instead of the second data signal indicating the pixel value of the specific pixel included in the data signals based on the image data (Step S411). The third data signal is a data signal having a pattern for causing the signal level to continuously rise and fall a plurality of times in the same cycle as the clock signal. Then, the adjusting section 13 reads, from the FPGAs 12*a* and 12*b*, a third received data signal corresponding to a data signal received by the FPGAs 12*a* and 12*b* from the TCONs 11*a* and 11*b* having received the third instruction (Step S412).

Next, the adjusting section 13 performs, as the receipt result determination, third determination based on the third data signal and the third received data signal (Step S402). Specifically, when the third received data signal read from the FPGAs 12*a* and 12*b* accords with the third data signal, the adjusting section 13 determines the result of the third determination as positive, namely, determines that the third data signal transmitted by the TCONs 11*a* and 11*b* could be correctly received by the FPGAs 12*a* and 12*b*. On the other hand, when the third received data signal read from the FPGAs 12*a* and 12*b* does not accord with the third data signal, the adjusting section 13 determines the result of the third determination as negative, namely, determines that the third data signal transmitted by the TCONs 11*a* and 11*b* could not be correctly received by the FPGAs 12*a* and 12*b*.

When the result of the third determination is positive (Step S402: YES), the adjusting section 13 completes one periodic processing, and returns the processing to Step S11 of the flowchart of FIG. 3.

On the other hand, when the result of the third determination is negative (Step S402: NO), the adjusting section 13 issues, to the TCONs 11*a* and 11*b*, a fourth instruction, regarding transmission of the third data signal instead of the second data signal with the phase difference from the clock signal set to a third phase difference, to increase the third phase difference by a prescribed increment successively every time the third data signal is transmitted (Step S441). Then, the adjusting section 13 repeatedly performs the third determination regarding the fourth instruction a plurality of times.

Specifically, every time the TCONs 11*a* and 11*b* transmit the third data signal after the issue of the fourth instruction, the adjusting section 13 reads the third received data signal from the FPGAs 12*a* and 12*b* (Step S442). Then, the adjusting section 13 performs the third determination based on the third received data signal and the third data signal read in Step S442 (Step S405). The adjusting section 13 stores, in the memory 102, the third phase difference specified by the fourth instruction and the result of the third determination in association (Step S406).

The adjusting section 13 determines whether or not the procedures of Steps S441 to S406 have been executed a prescribed number of times (Step S407). When it is determined that the procedures have not been executed the prescribed number of times (Step S407: NO), the adjusting section 13 returns the processing to Step S441.

On the other hand, when it is determined in Step S407 that the procedures have been executed a prescribed number of times (Step S407: YES), the adjusting section 13 specifies, based on association relationship between the third phase difference and the result of the third determination stored in the memory 102, a range of at least one third phase difference with which the FPGAs 12*a* and 12*b* could correctly receive the third data signal (Step S408). Then, the adjusting section 13 changes the set phase difference to a medium of the range of the at least one third phase difference specified in Step S408 (Step S409).

Thereafter, the adjusting section 13 outputs, to the TCONs 11*a* and 11*b*, an instruction signal for instructing to output the data signal based on the image data with the changed set phase difference (Step S410). The adjusting section 13 completes one periodic processing after Step S410, and returns the processing to Step S11 of the flowchart of FIG. 3.

Figure 8:
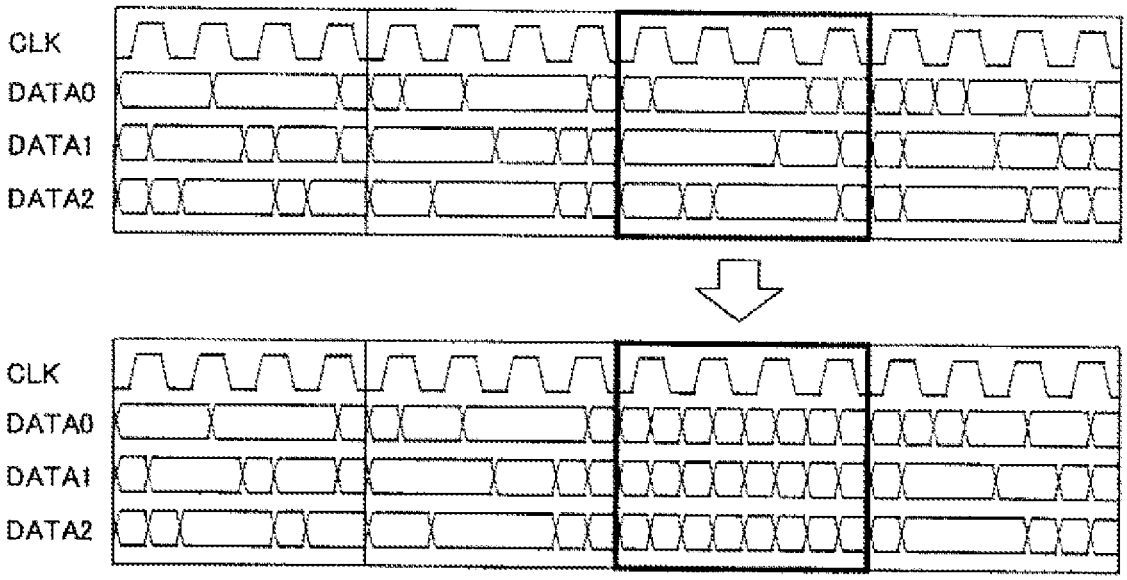
FIG. 8 is an explanatory diagram of data replacement performed in the second embodiment.

FIG. 8 is an explanatory diagram of data replacement performed in the second embodiment. FIG. 8 illustrates a time chart of the data signals transmitted by the TCONs 11*a* and 11*b* to the FPGAs 12*a* and 12*b*. The time chart is divided into four parts in FIG. 8, and each of the four parts indicates a signal range corresponding to one pixel. An upper portion of FIG. 8 indicates data signals based on image data (namely, data signals prior to the data replacement), and a lower portion of FIG. 8 indicates data signals obtained after the data replacement to the specific pattern according to the instruction of Step S411 (or Step S441). A part surrounded with a thick rectangle indicates a signal range corresponding to the specific pixel. As illustrated in FIG. 8, the specific pattern is a pattern in which the signal level is frequently switched between a high level and a low level (to form bit strings of 0, 1, 0, 1, etc.), namely, a signal pattern for causing the signal level to continuously rise and fall a plurality of times in the same cycle as the clock signal. In transmitting the data signal of such a specific pattern, if the phase is shifted, the FPGAs 12*a* and 12*b* are highly liable to repeatedly fail to receive the data signal.

In the second embodiment, the receipt result determination is performed under stringent conditions during the operation, and hence, the set phase difference can be more certainly optimized with high determination accuracy. Owing to the more certain optimization of the set phase difference, the display quality can be more certainly retained.

Although the adjusting section 13 issues, in Step S441, the fourth instruction to increase the third phase difference by the prescribed increment successively every time the third data signal is transmitted, the fourth instruction may be an instruction to decrease the third phase difference by a prescribed decrement successively every time the third data signal is transmitted.

Third Embodiment

Figure 9:
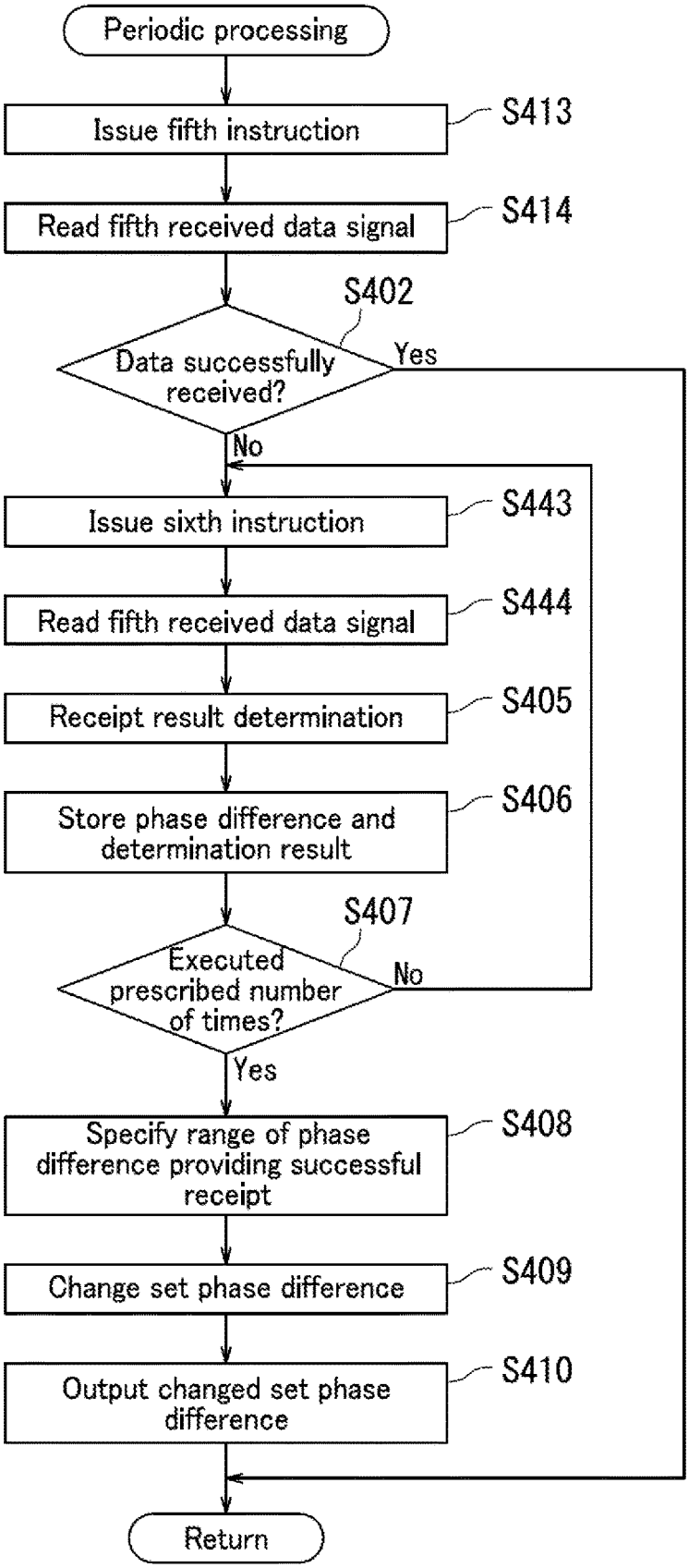
FIG. 9 is a flowchart of periodic processing performed in a third embodiment.

The structure of a display device 1 according to a third embodiment is the same as that of the first embodiment except for details of the processing performed by the signal processing circuit 10, and hence like reference signs are used to refer to like elements to avoid redundant detailed description. FIG. 9 is a flowchart of periodic processing of the third embodiment. Among procedures illustrated in the flowchart of FIG. 9, procedures common to those illustrated in the flowchart of FIG. 4 of the first embodiment are referred to with the same step numbers.

In the periodic processing of the third embodiment, the adjusting section 13 first issues, to the TCONs 11*a* and 11*b*, a fifth instruction to transmit a fifth data signal having a specific pattern instead of the fourth data signal indicating the pixel value of an arbitrary pixel included in the data signals based on the image data (Step S413). The fifth data signal is a data signal having a pattern for causing the signal level to continuously rise and fall a plurality of times in the same cycle as the clock signal. Then, the adjusting section 13 reads, from the FPGAs 12*a* and 12*b*, a fifth received data signal corresponding to a data signal received by the FPGAs 12*a* and 12*b* from the TCONs 11*a* and 11*b* having received the fifth instruction (Step S414).

Next, the adjusting section 13 performs, as the receipt result determination, fourth determination based on the fifth data signal and the fifth received data signal (Step S402). Specifically, when the fifth received data signal read from the FPGAs 12*a* and 12*b* accords with the fifth data signal, the adjusting section 13 determines the result of the fourth determination as positive, namely, determines that the fifth data signal transmitted by the TCONs 11*a* and 11*b* could be correctly received by the FPGAs 12*a* and 12*b*. On the other hand, when the fifth received data signal read from the FPGAs 12*a* and 12*b* does not accord with the fifth data signal, the adjusting section 13 determines the result of the fourth determination as negative, namely, determines that the fifth data signal transmitted by the TCONs 11*a* and 11*b* could not be correctly received by the FPGAs 12*a* and 12*b*.

When the result of the fourth determination is positive (Step S402: YES), the adjusting section 13 completes one periodic processing, and returns the processing to Step S11 of the flowchart of FIG. 3. In the third embodiment, an arbitrary pixel for replacement of the data signal may be changed every elapse of a prescribed time period.

On the other hand, when the result of the fourth determination is negative (Step S402: NO), the adjusting section 13 issues, to the TCONs 11*a* and 11*b*, a sixth instruction, regarding transmission of the fifth data signal instead of the fourth data signal with the phase difference from the clock signal set to a fourth phase difference, to change the arbitrary pixel and increase the fourth phase difference by a prescribed increment every time the fifth data signal is transmitted (Step S443). Then, the adjusting section 13 performs the fourth determination regarding the sixth instruction repeatedly a plurality of times.

Specifically, every time the TCONs 11*a* and 11*b* transmit the fifth data signal after the issue of the sixth instruction, the adjusting section 13 reads the fifth received data signal from the FPGAs 12*a* and 12*b* (Step S444). Then, the adjusting section 13 performs the fourth determination based on the fifth received data signal and the fifth data signal read in Step S444 (Step S405). The adjusting section 13 stores, in the memory 102, the fourth phase difference specified by the sixth instruction and the result of the fourth determination in association (Step S406).

The adjusting section 13 determines whether or not the procedures of Steps S443 to S406 have been executed a prescribed number of times (Step S407). When it is determined that the procedures have not been executed the prescribed number of times (Step S407: NO), the adjusting section 13 returns the processing to Step S443.

On the other hand, when it is determined in Step S407 that the procedures have been executed a prescribed number of times (Step S407: YES), the adjusting section 13 specifies, based on association relationship between the fourth phase difference and the result of the fourth determination stored in the memory 102, a range of at least one fourth phase difference with which the FPGAs 12*a* and 12*b* could correctly receive the fifth data signal (Step S408). Then, the adjusting section 13 changes the set phase difference to a medium of the range of the at least one fourth phase difference specified in Step S408 (Step S409).

Thereafter, the adjusting section 13 outputs, to the TCONs 11*a* and 11*b*, an instruction signal for instructing to output the data signal based on the image data with the changed set phase difference (Step S410). The adjusting section 13 completes one periodic processing after Step S410, and returns the processing to Step S11 of the flowchart of FIG. 3.

Figure 10:
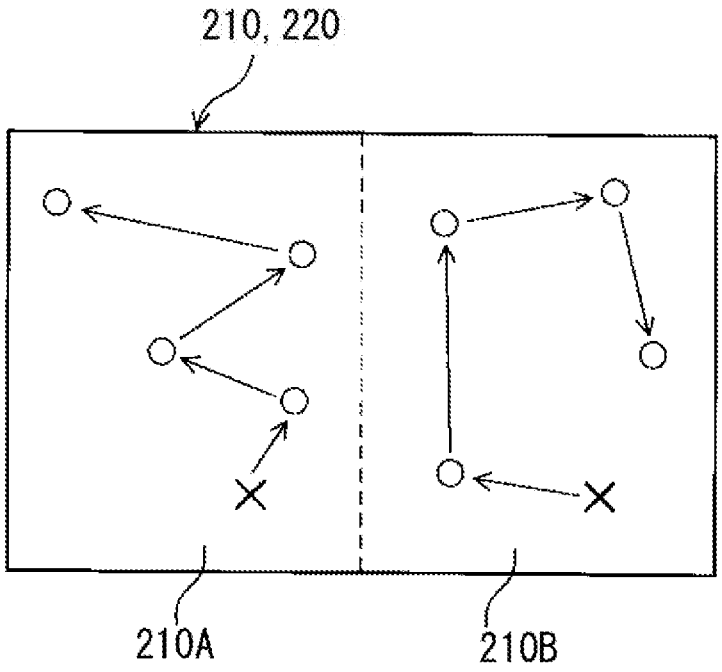
FIG. 10 is an explanatory diagram of a pixel for data replacement performed in the third embodiment.

FIG. 10 is an explanatory diagram of a pixel for the data replacement performed in the third embodiment. FIG. 10 illustrates a case where the display region 210 is divided into two regions. In one region 210A obtained by dividing the display region 210 into two regions, an input image is displayed in accordance with control data based on the data signal transmitted from the TCON 11*a* to the FPGA 12*a*, and in the other region 210B, an input image is displayed in accordance with control data based on the data signal transmitted from the TCON 11*b* to the FPGA 12*b*. "X" in the drawing indicates an arbitrary pixel (pixel for replacement of the data signal) first set in each of the regions 210A and 210B. As illustrated in FIG. 10, the arbitrary pixel for replacement with the fifth data signal is changed every time the fifth data signal is transmitted in the third embodiment. A circle pointed by each arrow in the drawing indicates a changed arbitrary pixel. Between the two regions 210A and 210B, different pixels may be selected as the arbitrary pixel.

In the third embodiment, the receipt result determination is performed under stringent conditions during the operation, and hence the set phase difference can be more certainly optimized with high determination accuracy. Owing to the more certain optimization of the set phase difference, the display quality can be more certainly retained. In the third embodiment, the receipt result determination is performed with the pixel for replacement of the data signal successively changed, and hence, the set phase difference can be certainly optimized with higher determination accuracy than in the second embodiment.

Although the adjusting section 13 issues, in Step S443, the sixth instruction to increase the fourth phase difference by the prescribed increment successively every time the fifth data signal is transmitted, the sixth instruction may be an instruction to decrease the fourth phase difference by a prescribed decrement successively every time the fifth data signal is transmitted.

Fourth Embodiment

Figure 11:
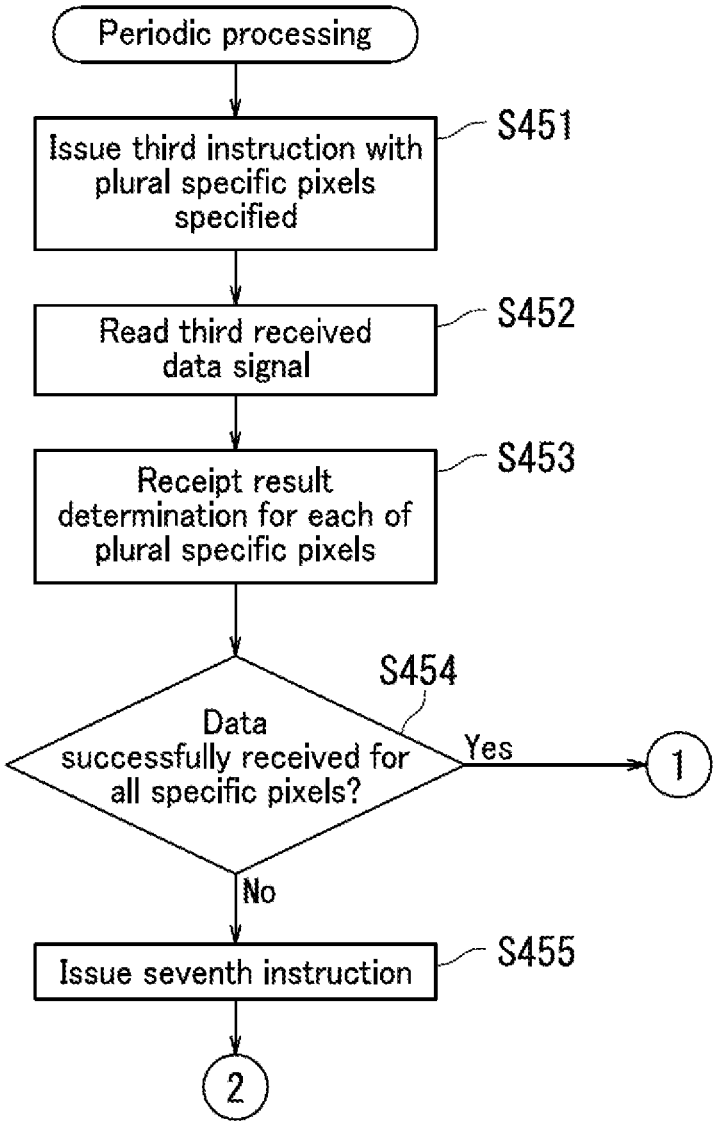
FIG. 11 is a flowchart of periodic processing performed in a fourth embodiment.
Figure 12:
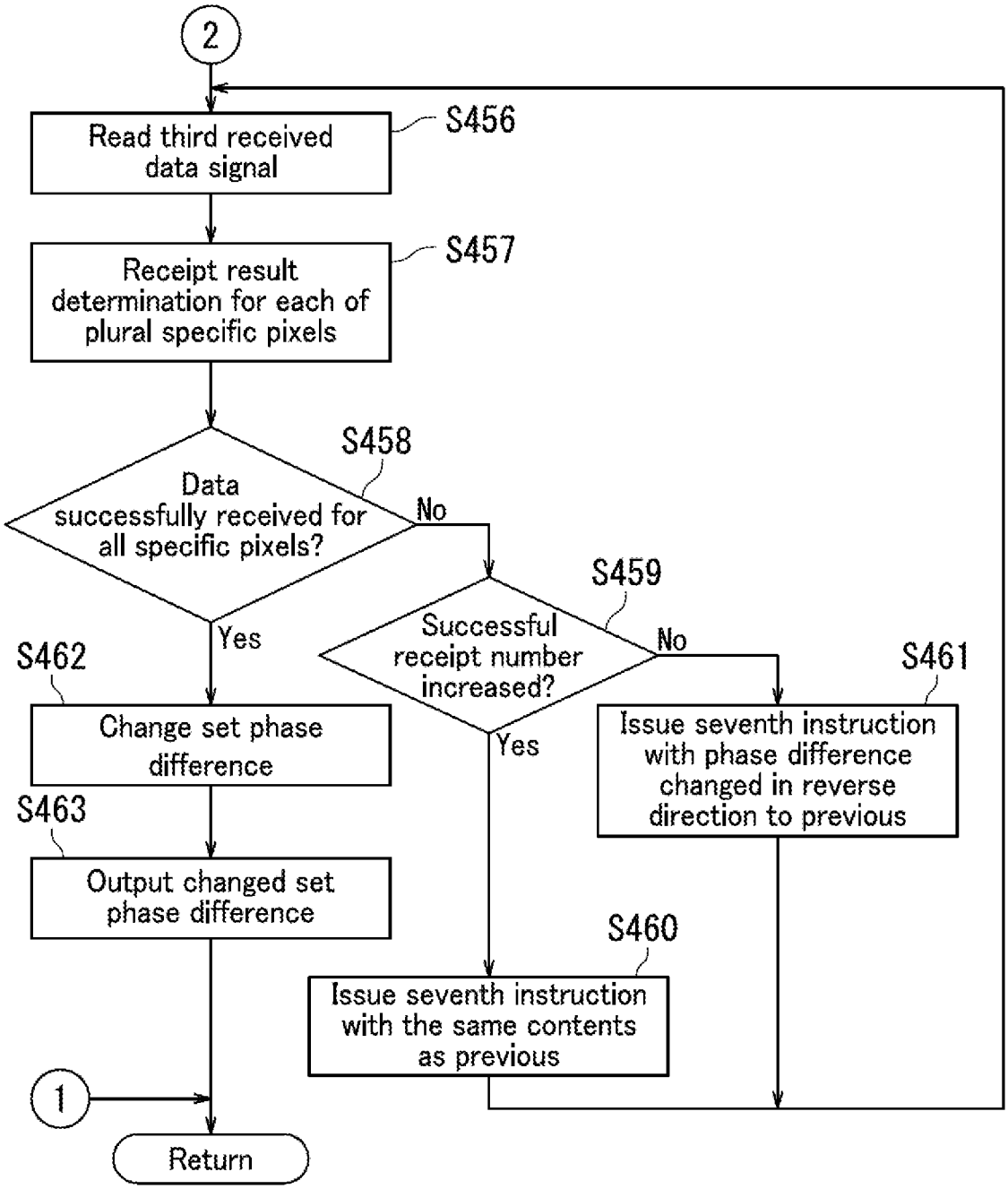
FIG. 12 is another flowchart of the periodic processing performed in the fourth embodiment.

The structure of a display device 1 according to a fourth embodiment is the same as that of the first embodiment except for details of the processing performed by the signal processing circuit 10, and hence like reference signs are used to refer to like elements to avoid redundant detailed description. FIGS. 11 and 12 are flowcharts of periodic processing of the fourth embodiment.

In the periodic processing of the fourth embodiment, the adjusting section 13 first issues, to the TCONs 11*a* and 11*b*, a third instruction with a plurality of specific pixels specified (Step S451). In other words, the adjusting section 13 issues, to the TCONs 11*a* and 11*b*, the third instruction to transmit, with respect to each of the plurality of specific pixels, a third data signal having a specific pattern instead of the second data signal indicating the pixel value of the specific pixel included in the data signals based on the image data (Step S451). Then, the adjusting section 13 reads, from the FPGAs 12*a* and 12*b*, a third received data signal corresponding to a data signal received by the FPGAs 12*a* and 12*b* from the TCONs 11*a* and 11*b* having received the third instruction (Step S452). The adjusting section 13 reads, with respect to each of the plurality of specific pixels, the third received data signal from the FPGAs 12*a* and 12*b*.

Next, the adjusting section 13 performs third determination, with respect to each of the plurality of specific pixels, based on the third data signal and the third received data signal read in Step S452 (Step S453).

When the results of the third determination in Step S453 with respect to all the plurality of specific pixels are positive (Step S454: YES), the adjusting section 13 completes one periodic processing, and returns the processing to Step S11 of the flowchart of FIG. 3.

On the other hand, when the result of the third determination performed in Step S453 with respect to any one or more pixels out of the plurality of specific pixels is negative (Step S454: NO), the adjusting section 13 issues, to the TCONs 11*a* and 11*b*, a seventh instruction to transmit the third data signal instead of the second data signal with the phase difference from the clock signal set to a fifth phase difference obtained by increasing or decreasing the previously specified phase difference by a prescribed increment or decrement (Step S455). Here, the adjusting section 13 stores, in the memory 102, the number of specific pixels with respect to which the result of the third determination obtained in Step S453 is positive (successful receipt number).

Thereafter, the adjusting section 13 reads a third received data signal from the FPGAs 12*a* and 12*b* every time the TCONs 11*a* and 11*b* transmit the third data signal after issuing the seventh instruction (Step S456). Then, the adjusting section 13 performs the third determination with respect to each of the plurality of specific pixels based on the third data signal and the third received data signal read in Step S456 (Step S457).

When the results of the third determination performed with respect to all the plurality of specific pixels in Step S457 are positive (Step S458: YES), the adjusting section 13 changes the set phase difference to the fifth phase difference specified by the seventh instruction (Step S462).

Thereafter, the adjusting section 13 outputs, to the TCONs 11*a* and 11*b*, an instruction signal for instructing to output the data signal based on the image data with the changed set phase difference (Step S463). The adjusting section 13 completes one periodic processing after Step S463, and returns the processing to Step S11 of the flowchart of FIG. 3.

On the other hand, when the result of the third determination obtained in Step S457 with respect to any one or more pixels out of the plurality of specific pixels is negative (S458: NO), the adjusting section 13 determines whether or not the number of specific pixels with respect to which the result of the third determination obtained in Step S457 is positive (the latest successful receipt number) is larger than the previous successful receipt number stored in the memory 102 (Step S459). Here, the adjusting section 13 updates the successful receipt number stored in the memory 102 to the latest successful receipt number.

When the latest successful receipt number is larger than the previous successful receipt number (Step S459: YES), the adjusting section 13 issues, to the TCONs 11*a* and 11*b*, the seventh instruction with the same contents as the previous instruction (Step S460), and returns the processing to Step S456. In other words, when the phase difference increased by the prescribed increment from the previously specified value is specified as the fifth phase difference in the previously issued seventh instruction, the adjusting section 13 specifies, also in the seventh instruction issued in Step S460, the phase difference increased by the prescribed increment from the previously specified value as the fifth phase difference. On the other hand, when the phase difference decreased by the prescribed decrement from the previously specified value is specified as the fifth phase difference in the previously issued seventh instruction, the adjusting section 13 specifies, also in the seventh instruction issued in Step S460, the phase difference decreased by the prescribed decrement from the previously specified value as the fifth phase difference.

On the other hand, when the latest successful receipt number is no greater than the previous successful receipt number (Step S459: NO), the adjusting section 13 issues, to the TCONs 11*a* and 11*b*, the seventh instruction with the fifth phase difference changed in the reverse direction from that in the previous instruction (Step S461), and returns the processing to Step S456. In other words, when the phase difference increased by the prescribed increment from the previously specified value is specified as the fifth phase difference in the previously issued seventh instruction, the adjusting section 13 specifies, in the seventh instruction issued in Step S460, the phase difference decreased by the prescribed decrement from the previously specified value as the fifth phase difference. On the other hand, when the phase difference decreased by the prescribed decrement from the previously specified value is specified as the fifth phase difference in the previously issued seventh instruction, the adjusting section 13 specifies, in the seventh instruction issued in Step S460, the phase difference increased by the prescribed increment from the previously specified value as the fifth phase difference.

Figure 13:
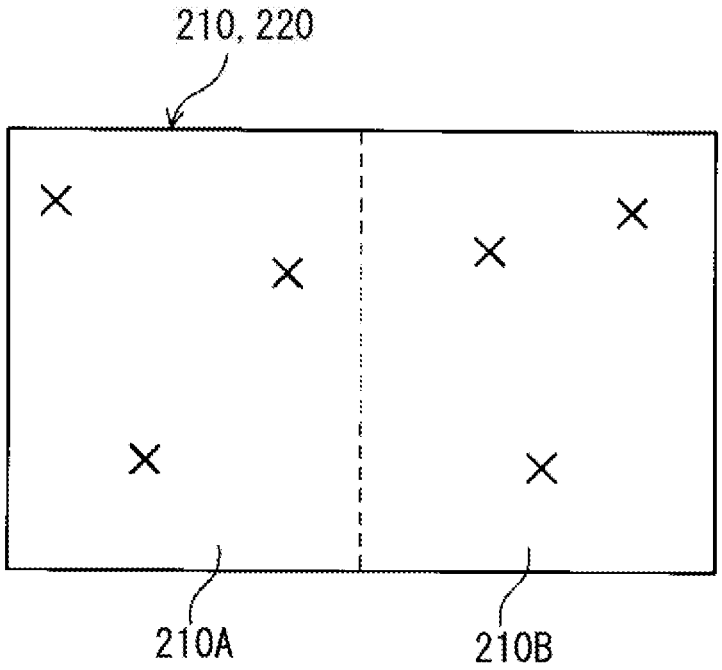
FIG. 13 is an explanatory diagram of a pixel for data replacement performed in the fourth embodiment.

FIG. 13 is an explanatory diagram of a pixel for the data replacement performed in the fourth embodiment. FIG. 13 illustrates a case where the display region 210 is divided into two regions. In one region 210A obtained by dividing the display region 210 into two regions, an input image is displayed in accordance with control data based on the data signal transmitted from the TCON 11*a* to the FPGA 12*a*, and in the other region 210B, an input image is displayed in accordance with control data based on the data signal transmitted from the TCON 11*b* to the FPGA 12*b*. Each "X" in the drawing indicates each of a plurality of specific pixels set in each of the regions 210A and 210B. Between the two regions 210A and 210B, different pixels may be selected as the specific pixels.

In each of the first to third embodiments, when the result of the receipt result determination periodically performed at the display stage is negative, the adjusting section 13 changes the phase difference from the clock signal for transmission of a data signal a prescribed number of times, and the set phase difference is changed in accordance with whether or not the data signal is correctly received. In other words, in each of the first to third embodiments, a time obtained by multiplying the prescribed number of times by a time length of one frame is required from when the result of the receipt result determination periodically performed at the display stage is determined as negative until the set phase difference is changed. On the contrary, in the fourth embodiment, the set phase difference can be changed within the time length of one frame after the result of the receipt result determination periodically performed at the display stage is determined as negative, and hence, the time necessary for adjusting the set phase difference can be shortened.

Incidentally, in the fourth embodiment, the adjusting section 13 may perform, without performing the replacement of the data signal, the second determination based on the second data signal and the second received data signal instead of performing the third determination.

The embodiments disclosed herein are to be considered in all respects as only illustrative and not restrictive. The scope of the invention is, therefore, indicated by the appended claims rather than by the foregoing description, and all changes which come within the meaning and range of equivalency of the claims are to be embraced within their scope.

The invention claimed is:

1. A display device, comprising:

a display panel having a display region constituted by a plurality of pixels; and a signal processing section configured to perform prescribed signal processing on input data including pixel values of the respective plurality of pixels for generating first output data for displaying an input image based on the input data in the display region, wherein the signal processing section includes:

a receiving section;

a transmitting section configured to transmit, to the receiving section, a data signal based on the input data or a specified data signal in synchronization with a clock signal; and a controller connected to the receiving section and the transmitting section, at a previous stage prior to displaying the input image in the display region, the controller issues, to the transmitting section, a first instruction to transmit a first data signal having a specific pattern with a phase difference from the clock signal set to a first phase difference, reads, from the receiving section, a first received data signal corresponding to a data signal received by the receiving section from the transmitting section having received the first instruction, performs first determination based on the first data signal and the first received data signal as receipt result determination whether or not the data signal transmitted by the transmitting section has been able to be correctly received by the receiving section, and determines, based on a result of the first determination, a set phase difference corresponding to a phase difference from the clock signal employed in transmitting the data signal based on the input data.

2. The display device according to claim 1, wherein the controller issues the first instruction with the first phase difference successively increased or decreased repeatedly a plurality of times, and performs the first determination a plurality of times, and specifies, based on results of the first determination performed a plurality of times, at least one first phase difference with which the receiving section has been able to correctly receive the first data signal, and determines the set phase difference based on the specified at least one first phase difference.

3. The display device according to claim 1, wherein at a display stage for displaying the input image in the display region, the controller periodically or irregularly performs phase difference update processing for changing the set phase difference, the set phase difference being changed when a result of the receipt result determination performed is negative.

4. The display device according to claim 3, wherein in the phase difference update processing, the controller reads a second data signal indicating a pixel value of a specific pixel included in data signals based on the input data from the transmitting section having transmitted the second data signal, reads, from the receiving section, a second received data signal corresponding to a data signal received by the receiving section from the transmitting section having transmitted the second data signal, performs, as the receipt result determination, second determination based on the second data signal and the second received data signal, when a result of the second determination is negative, issues, to the transmitting section, a second instruction, regarding transmission of the second data signal with the phase difference from the clock signal set to a second phase difference, to increase or decrease the second phase difference successively every time the second data signal is transmitted, and performs the second determination regarding the second instruction repeatedly a plurality of times, and specifies, based on results of the second determination regarding the second instruction having been performed the plurality of times, at least one second phase difference with which the receiving section has been able to correctly receive the second data signal, and changes the set phase difference based on the specified at least one second phase difference.

5. The display device according to claim 3, wherein in the phase difference update processing, the controller issues, to the transmitting section, a third instruction to transmit a third data signal having a specific pattern instead of a second data signal indicating a pixel value of a specific pixel included in data signals based on the input data, reads, from the receiving section, a third received data signal corresponding to a data signal received by the receiving section from the transmitting section having received the third instruction, performs, as the receipt result determination, third determination based on the third data signal and the third received data signal, when a result of the third determination is negative, issues, to the transmitting section, a fourth instruction, regarding transmission of the third data signal instead of the second data signal with the phase difference from the clock signal set to a third phase difference, to increase or decrease the third phase difference successively every time the third data signal is transmitted, and performs the third determination regarding the fourth instruction repeatedly a plurality of times, and specifies, based on results of the third determination regarding the fourth instruction having been performed the plurality of times, at least one third phase difference with which the receiving section has been able to correctly receive the third data signal, and changes the set phase difference based on the specified at least one third phase difference.

6. The display device according to claim 3, wherein in the phase difference update processing, the controller issues, to the transmitting section, a fifth instruction to transmit a fifth data signal having a specific pattern instead of a fourth data signal indicating a pixel value of an arbitrary pixel included in data signals based on the input data, reads, from the receiving section, a fifth received data signal corresponding to a data signal received by the receiving section from the transmitting section having received the fifth instruction, performs, as the receipt result determination, fourth determination based on the fifth data signal and the fifth received data signal, when a result of the fourth determination is negative, issues, to the transmitting section, a sixth instruction, regarding transmission of the fifth data signal instead of the fourth data signal with the phase difference from the clock signal set to a fourth phase difference, to change the arbitrary pixel and increase or decrease the fourth phase difference successively every time the fifth data signal is transmitted, and performs the fourth determination regarding the sixth instruction repeatedly a plurality of times, and specifies, based on results of the fourth determination regarding the sixth instruction having been performed the plurality of times, at least one fourth phase difference with which the receiving section has been able to correctly receive the fifth data signal, and changes the set phase difference based on the specified at least one fourth phase difference.

7. The display device according to claim 3, wherein in the phase difference update processing, the controller issues, to the transmitting section, a third instruction to transmit, with respect to each of a plurality of specific pixels among the plurality of pixels, a third data signal having a specific pattern instead of a second data signal indicating a pixel value of the specific pixel included in data signals based on the input data, reads, from the receiving section, a third received data signal corresponding to a data signal received by the receiving section from the transmitting section having received the third instruction, performs, as the receipt result determination, third determination based on the third data signal and the third received data signal with respect to each of the plurality of specific pixels, when a result of the third determination of at least one pixel among the plurality of specific pixels is negative, issues, to the transmitting section, a seventh instruction to transmit the third data signal instead of the second data signal with the phase difference from the clock signal set to a fifth phase difference obtained by increasing or decreasing a previous phase difference with respect to each of the plurality of specific pixels, and performs fifth determination corresponding to the third determination regarding the seventh instruction with respect to each of the plurality of specific pixels, determines, when a result of the fifth determination of at least one pixel out of the plurality of specific pixels is negative, whether or not the number of specific pixels determined as positive as a result of the fifth determination is increased as compared with the number determined in previous determination, when the number of specific pixels determined as positive as a result of the fifth determination is increased as compared with the number determined in the previous determination, issues the seventh instruction with the same contents as the previous instruction to the transmitting section, and when the number of specific pixels determined as positive as a result of the fifth determination is no greater than the number determined in the previous determination, issues, to the transmitting section, the seventh instruction reverse in direction of change of the fifth phase difference, and when results of the fifth determination of all the plurality of specific pixels are positive, changes the set phase difference to the fifth phase difference specified in the seventh instruction having been issued latest.

8. The display device according to claim 1, wherein the signal processing section outputs the first output data to the display panel at a display stage for displaying the input image in the display region, and at the previous stage, outputs, to the display panel, second output data for displaying the respective plurality of pixels in black.

9. The display device according to claim 1, wherein the data signal having the specific pattern is a data signal having a pattern for causing a signal level to continuously rise and fall a plurality of times in the same cycle as the clock signal.

10. A data transmission method performed in a display device including: a display panel having a display region constituted by a plurality of pixels; and a signal processing section including a receiving section and a transmitting section and configured to perform prescribed signal processing on input data including pixel values of the respective plurality of pixels for generating output data for displaying an input image based on the input data in the display region, the method comprising, at a previous stage prior to displaying the input image in the display region:

issuing, to the transmitting section, a first instruction to transmit a first data signal having a specific pattern with a phase difference from a clock signal set to a first phase difference;

reading, from the receiving section, a first received data signal corresponding to a data signal received by the receiving section from the transmitting section having received the first instruction;

performing determination based on the first data signal and the first received data signal as receipt result determination whether or not the data signal transmitted by the transmitting section has been able to be correctly received by the receiving section; and determining, based on a result of the determination, a set phase difference corresponding to a phase difference from the clock signal employed in transmitting the data signal based on the input data, wherein at a display stage for displaying the input image in the display region, the transmitting section transmits the data signal based on the input data with the set phase difference.

11. The display device according to claim 2, wherein the controller determines, as the set phase difference, a median of a range of the specified at least one first phase difference.

12. The display device according to claim 4, wherein the controller changes the set phase difference to a median of a range of the specified at least one second phase difference.

13. The display device according to claim 5, wherein the controller changes the set phase difference to a median of a range of the specified at least one third phase difference.

14. The display device according to claim 6, wherein the controller changes the set phase difference to a median of a range of the specified at least one fourth phase difference.

* * * * *